340-566 SR
4/8/80 OR 4,197,529

United States Patent [19]
Ramstedt et al.

[11] 4,197,529
[45] Apr. 8, 1980

[54] INTRUSION DETECTION APPARATUS

[75] Inventors: Clarence F. Ramstedt, San Diego, Calif.; Tibor G. Horwath, Arlington, Va.

[73] Assignee: The United States of America as represented by the Secretary of the Navy, Washington, D.C.

[21] Appl. No.: 878,560

[22] Filed: Feb. 17, 1978

[51] Int. Cl.[2] ..... G08B 13/10; H01B 11/12

[52] U.S. Cl. ..... 340/566; 174/99 R; 174/102 R; 174/113 AS; 324/66; 333/241; 340/562; 361/283

[58] Field of Search ..... 340/562, 566, 565; 324/61 R, 66, 67, 182, 25, 26; 333/81 R, 84 R, 95 A, 222, 236, 238, 241; 174/28, 36, 37, 99 R, 102 R, 106 R, 113 AS, 117 AS; 310/308; 361/283, 291; 177/210 C, 133

[56] References Cited

U.S. PATENT DOCUMENTS

| | | | |
|---|---|---|---|
| 3,009,008 | 11/1961 | Lapsley et al. | 174/102 R X |
| 3,274,329 | 9/1966 | Timmons | 174/106 X |
| 3,633,194 | 6/1972 | Kothe | 340/562 X |
| 3,668,625 | 6/1972 | Wolf et al. | 340/562 X |
| 3,684,816 | 8/1972 | Reighter | 174/28 X |
| 3,750,126 | 7/1973 | Solomon | 340/562 |
| 3,803,548 | 4/1974 | Skujins, Jr. | 340/566 X |
| 3,846,780 | 11/1974 | Gilcher | 340/562 |
| 4,095,040 | 6/1978 | Cookson | 174/28 |

*Primary Examiner*—John W. Caldwell, Sr.
*Assistant Examiner*—Joseph E. Nowicki
*Attorney, Agent, or Firm*—Richard S. Sciascia; Ervin F. Johnston; John Stan

[57] ABSTRACT

A specially configured cable, which, in use, has a cross section which is symmetrical to a vertical line, but asymmetrical to a horizontal line, is used for an intrusion detection system. It comprises an external sheath, which may be round or rectangular in cross section. An inner conductor is positioned below the center of the cable. It is supported in place by a thin, substantially flat, sheet of insulating material, which is attached to the inner surface of the outer sheath. This particular configuration maximizes the change in capacitance caused by an intruder passing over the cable. The cable is connected to a time-domain reflectometer, which can display on a screen the location of the intrusion with respect to an end of the cable as well as the probable type of intrusion.

16 Claims, 9 Drawing Figures

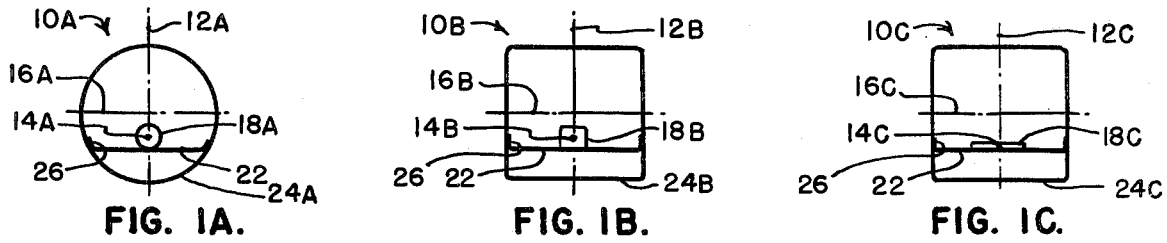
FIG. 1A. FIG. 1B. FIG. 1C.
FIG. 1. TYPES OF CABLE USEFUL FOR INTRUSION DETECTION APPARATUS.
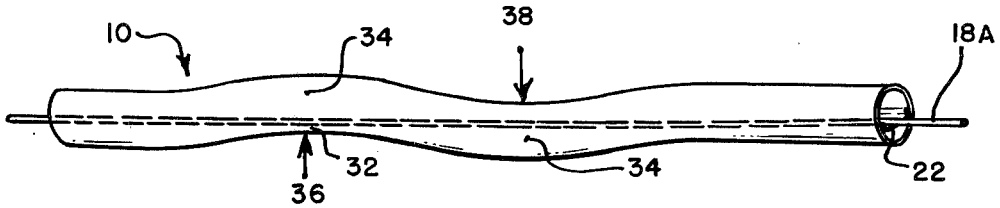
FIG. 2. DEFLECTION OF CABLE BY INTRUDER.
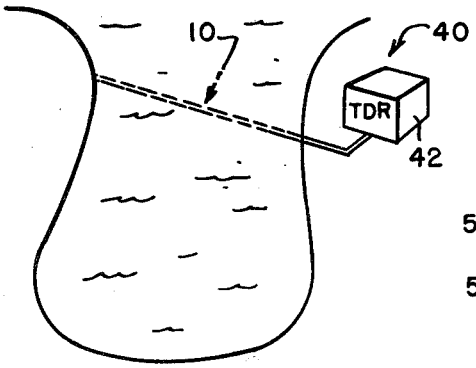
FIG. 3. INTRUSION DETECTION APPARATUS IN USE.
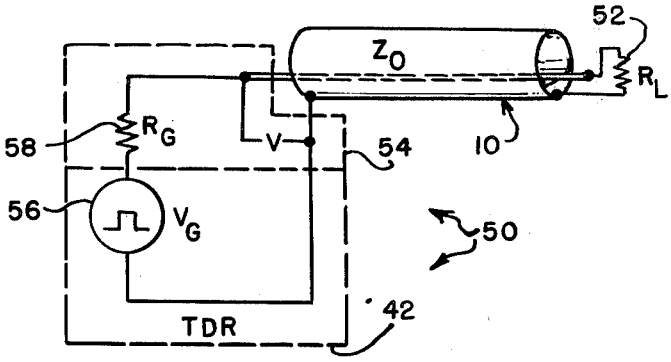
FIG. 4. INTRUSION DETECTION APPARATUS USING A TIME-DOMAIN REFLECTOMETER.
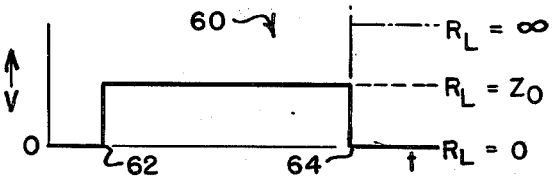
FIG. 5. VARIATION IN THE IMPEDANCE OF THE CABLE.
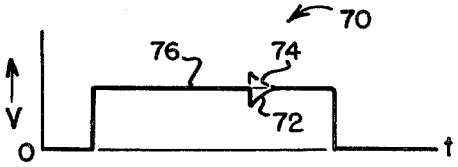
FIG. 6. VARIATION IN PATTERN ON TDR VIEWER.

INTRUSION DETECTION APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The intrusion detection apparatus comprises two principal components, an electrical cable of unique design and an instrument commonly known as a time-domain reflectometer (TDR), which, when suitably combined, provide an electrical response to, and a video display of, induced cable motion or vibration. This motion or vibration may occur at a single point, at any number of points, along a continuous portion of the cable, or along the entire length of the cable. The horizontal trace on the video display represents the length of the cable and the occurrence of cable motion or vibration is displayed as a vertical displacement of a trace at a point or region whose location within the trace corresponds to the location of the actual motion or vibration within the length of the cable. Thus, this invention provides an indication of both the occurrence and location of motion or vibration within the length of the cable.

The process of monitoring motion and vibration over large distributed areas is accomplished in the prior art with two classes of devices: point sensors and short line sensors which provide no location resolution. The short line sensors, which may typically be up to 100 meters in length, function as a single sensor in that an indicated response cannot be identified with a particular point along the line. None make use of the time-domain reflectometry cable technology which is the subject of this invention. Thus, as in the case in most if not all applications, many of these short line sensors must be used in order to obtain the required area monitoring, and each line sensor requires a separate link monitoring room.

Point sensors such as microphones, geophones, and accelerometers are used to provide monitoring of specific points, and are placed in a continuous line in order to accomplish the monitoring of property boundaries. In the latter instance, very large numbers of sensors are required, and each must have a separate link to the central monitoring rooms.

In most of the common applications of existing line point sensors, some source of electrical power is required at the sensor end of the link to operate the link circuits. Thus, either batteries must be used and periodically charged, or a separate power supply line must be incorporated in the system.

Because of the great numbers of sensors which are generally required, central station data processing is generally simplified through the application of threshold circuits at the sensor end of the link. In this case, only one signal level is transmitted and this occurs when the sensor signal exceeds the threshold minimum. Thus, no magnitude or frequency analysis is possible, as in the apparatus of this invention.

SUMMARY OF THE INVENTION

A cable, when in use, has a vertical plane of symmetry and an axis on this plane which is located below the center line of the cable. The cable has an inner metallic conductor which is centered about the axis. A thin, substantially flat, horizontal sheath of insulating material makes contact with and supports the conductor. An outer sheath, rigid or semirigid, encloses the conductor in the sheath, the flat sheet having its edges attached to the inside surface of the sheath.

In one embodiment of the cable, the metallic conductor is circular in cross section, and the metallic sheath has the cross section of a hollow cylinder. The metallic conductor and sheath may be made of copper. On the other end, if used under water the metallic conductor and sheath would be made of stainless steel.

Another form of the invention includes the cable described hereinabove in an intrusion protection apparatus. The apparatus includes the cable and means for terminating the cable in its characteristic impedance. The means will generally comprise an impedance, labeled herein $Z_0$. Means are connected to the other termination of the cable for injecting a pulse into the cable, which propagates to the end terminating in the characteristic impedance. If there is an intrusion, the pulse will be reflected back to the connecting termination.

Means are also connected to the other termination of the cable for displaying the transmitted pulse, and the reflected pulse if any. The pulse-injecting means and the displaying means may comprise the time-domain reflectometer.

OBJECTS OF THE INVENTION

An object of the invention is to provide a single-cable sensor which is much longer than previously obtainable.

Another object of the invention is to provide a long cable-sensor allowing resolution of the intrusion at a specific part of the cable.

Still another object of the invention is to provide a long cable-sensor which permits a distortion-free frequency spectrum and auditory and visual analysis of the signals resulting from any selectable, small, section of the cable or from the entire cable.

Yet another object of the invention is to provide a long cable-sensor which has output voltages that can automatically be monitored by circuits selected to measure either signal magnitudes or frequency content or both.

Finally, another object of the invention is to provide a long cable-sensor which requires no supplementary power to or accessory instrumentation along the line to support its functioning.

These and other objects of the invention will become more readily apparent from the ensuing specification, when taken together with the drawings.

BRIEF DESCRIPTION OF THE DRAWINGS

FIG. 1 is a set of three cross-sections of typical cables which may be used with the intrusion detection apparatus of this invention;

FIG. 1A shows a cable having a round sheath and a round inner conductor;

FIG. 1B shows a cable having a square sheath and a square conductor; and

FIG. 1C shows a cable with a square sheath and a metallized inner conductor.

FIG. 2 is a diagram showing how the cable may be deflected by an intruder.

FIG. 3 is a sketch showing the principal components of a intrusion detection apparatus in use, with the cable being buried shallowly in earth.

FIG. 4 is a view, partially schematic and partially diagrammatic, showing how a time-domain reflectometer would be connected to the cable.

FIG. 5 is a set of graphs showing how the pattern of the video screen would vary with the variation in the impedance of the cable, caused by an intruder deflecting the cable.

FIG. 6 is a graph showing the variation in pattern, that is the variation in the voltage, as a function of time caused by an intruder deflecting the cable at one point.

DESCRIPTION OF THE PREFERRED EMBODIMENTS

Referring now to FIG. 1, therein is shown three representative types of cable, 10A, 10B and 10C, of the type useful for the intrusion detection apparatus of this invention. The three cables, 10A, 10B, and 10C, have a vertical plane of symmetry 12A, 12B, and 12C, and an axis, 14A, 14B, and 14C, which is located below the horizontal center line, 16A, 16B, or 16C, of the cable.

An inner metallic conductor, 18A, 18B, or 18C, is centered about the axis, 14A, 14B, or 14C. A thin, substantially flat, horizontal sheet 22 makes contact with and supports the conductor, 18A, 18B or 18C, an elastic manner.

An outer metallic sheath, 24A, 24B, or 24C, encloses the inner conductor, 18A, 18B, or 18C, and sheet 22, the flat sheet having its edges attached to the inside surface of the sheath, as is shown by the beads, 26A, 26B, or 26C.

As shown in FIG. 1A, the metallic conductor 18A may be circular in cross section, whereas the metallic sheath 24A has the cross section of a hollow cylinder.

The metallic conductor 18A in the sheath 24A, if used in earth ground, would generally be made of copper, protected by plating, painting or a plastic coat. However, for under water use the sheath 24A would generally be made of stainless steel.

The diameter of the inner conductor 18A of the cable 10A could generally be in the range of 1.5 mm. The flat sheet 22 may be Mylar, having a thickness in the range of 0.1 mm. Mylar is a proprietary name for a material, polyethylene terephthalate, generally used in the form of a film, manufactured by E.I. duPont de Nemours & Co., Inc., Wilmington 98, Del. The Mylar sheet 22 may be attached to the inside of the outer sheath 24A by any of a number of adhesives. The Mylar sheet 22 may also be attached by thermal means, or by mechanical means, for example, by crimping it in place.

The sheath 24A typically has an outside diameter in the range of 1.5 cm and a thickness in the range of 1 mm.

In another type of configuration, the inner conductor 18A is a hollow cylinder. Specifically, as is shown in FIG. 1B, the inner conductor 18B may be hollow and have a rectangular cross section. In such a case, the outer sheath 24B would also be rectangular in cross section. More specifically, the inner conductor 18B and the outer conductor, or outer sheath 24B, may be square in cross section.

Discussing now some theory with respect to the chosen configurations of the cable, 10A, 10B, or 10C, the usual coaxial cables as they appear in the prior art are symmetrical in their construction, with the inner conductor being at the center of a round sheath. Such a cable can be constructed with an elastically suspended inner conductor, with a result that when an external force acts to move the sheath, the inner conductor will move but not instantly. There should be no difference in response time just because the cable is symmetrical. But there is another point to be clarified. In the prior art referred to above, the sensitive elements are geophones, microphones and accelerometers; and the cable is only a signal carrier-there the cable is not supposed to be displacement-sensitive.

The inner spacing at the point of displacement will decrease and a voltage reflection will be generated which can be measured and displayed at the input terminal. A cable designed for sensing motion and vibration, as is the cable of this invention, will contain an inner conductor which is elastically suspended away from the center at a region near the sheath. This design allows a larger percent gap change to result from a given amount of sheath motion as compared to a symmetrical cable; and, therefore, a TDR-line sensor assembled with this unique cable design will have a greater sensitivity to motion and vibration.

Referring now to FIG. 1C, therein is shown a cable 10C comprising an outer metallic sheath 24C configured so as to have a vertical plane of symmetry 12C. A thin, substantially flat, sheet 26 of insulating material is attached at its edges to the sheath, in a plane perpendicular to the line of symmetry. As may be seen, the plane of the sheet 22 is below the perpendicular plane 16B. A thin layer 18C of metal is deposited on the central part of the insulated sheet 26 so as to not touch the sheath, the layer of metal being on the top part of the insulating sheet.

In the cable 10C, the outer sheath 24C may be a hollow cylinder of stainless steel. As before the insulating sheet 26 is made of Mylar and the deposited metal 18C may be attached by adhesive or vacuum metalization.

Referring now to FIG. 2, therein is shown a cable 10 constructed with offset inner conductor 18A which can experience both a decrease in inner spacing, below the Mylar 22, shown by numeral 32, and an increase in inner spacing 34, as a result of sheath displacements, 36 and 38.

Buried cables will have displacement forces acting from above only. The spacing can increase when the center conductor oscillates on its elastic suspension after a downward force. In the structure monitoring examples described hereinabove, the force can come from any direction.

The resulting voltage responses for these two opposite conditions are shown in FIG. 6 as trace excursions 72 and 74, the static condition of the cable being shown by reference numeral 76.

In contrast, the effect of spacing, and thus the capacitance, in a symmetrical cable can only decrease with a sheath displacement which will introduce a distortion in any voltage response to be taken as a replica of the sheath motion. For example, the sheath is vibrating sinusoidly, the voltage response from the symmetrical cable will decrease twice for each vibration sine wave, which will cause harmonic generation, whereas the voltage response of the offset cable 10 of this invention will provide one sinusoidal increase and decrease in the voltage response for each vibration sine wave and no harmonic generation. By time gating, the operator can select the voltage response from any point in the cable, subject it to harmonic analysis or simply to listen to it;

thus, it is important to prevent distortion due to harmonic generation.

FIG. 3 shows a combination 40 of the intrusion detection apparatus 42 and the cable in use. The combination of a single cable 10 of unique design and a time-domain reflectometer provides a means of detecting, localizing, and analyzing the motion or vibration of the medium in which the cable is placed. In another embodiment, the cable 10 may be attached to a structure, which may be of great extent or size, and the vibration of the structure may be detected by the means described herein.

FIG. 3 shows a buried cable 10 in earth, underwater. This cable 10 needs a relative firm coupling medium between it and the source of displacement. Another very common use would be to have the cable 10 surround an area enclosing a structure.

Referring now to FIG. 4, wherein is shown an embodiment 50, comprising the cable 10 described hereinabove. Means 52 are provided for terminating the cable 10 in its characteristic impedance. Means 54 are connected to the other termination of the cable 10, for injecting a pulse into the cable which propagates to the end terminating in the characteristic impedance. This wave is reflected back to the connecting termination if there be an intrusion. Means 56 are also connected to the other termination of the cable 10, for displaying the transmitted pulse, and the reflected pulse if any.

The pulse injecting means 54 and the displaying means 56 may constitute a time-domain reflectometer 42.

The principal application for this invention is that of a buried line sensor applied to the detection of the activity and passage of individuals and vehicles. In this application, the cable 10 is placed in the earth along the boundaries of a property, while the time-domain reflectometer 42 and its accessory instruments are located in a central, attended or unattended, controlled building. The ground motion which results from such activities as persons or vehicles moving near or over the buried cable 10 transmitted to the cable sheath 24, with the result that an indication of this activity is presented to the monitoring personnel. Other similar activity-detecting functions can be obtained by the attachment of the cable 10 to a fence or bridge, or by placing it in the earth between buildings, along runways, roads and piers, in the floors and walls of buildings, and around islands which require special attention, such as water and fuel reservoirs and pipelines.

It is well known that the magnitude and spectra of ground displacements, and displacements in structures, can often be uniquely associated with particular causes of displacement. Thus, it is expected that in addition to allowing a detection and location of ground and structure motion or vibration, the information provided by this invention frequently permits the monitoring personnel to assess and identify the cause of the motion or vibration.

Any intrusion, whether by a person walking, a bicycle, or background noise due to train traffic, will induce in the ground some variation in spectra. The cable 10 of this invention allows the spectral analysis of the disturbance as well as its magnitude and location. But, in addition, a spectral analysis of the disturbance will allow an analysis of the actual disturbance itself. Over a period of time, a "library" of various types of disturbances can be established, so that the specific type of disturbance can be identified. The library could consist of the book showing pairs of illustrations, one showing the disturbance as it appears on the time-domain reflectometer 42 and another illustration showing a picture, for example, of a bicycle, causing the disturbance.

In yet a more sophisticated embodiment, the library could consist of an automatic processor which completes the analysis and makes a comparison with internally stored signatures. Means could be provided to alert the operator by providing him with one of a predetermined set of identifications.

The apparatus of this invention may be advantageously applied as an integral component with large vehicles, structures, and machines in which there are sources of vibration, and for which excessive vibration can indicate a failing bearing or device, or for which excessive vibration can degenerate operation and cause damage. Examples include aircraft, bridges, tunnels, large buildings, power generators, and processing plants.

Instruments which can be used for intrusion detection, using time-domain reflectometry, are the 1500 Series TDR Cable Testers manufactured by Tektronix, Inc., P.O. Box 500, Beaverton, Oreg. 97,077.

Referring back to FIG. 4, the voltage pulse $V_G$ has a short rise time, and has a duration which is longer in time than the time required for the pulse to travel from the input terminal of the cable 10 to the load end, $R_L$, and back to the input terminal. The pulse generator 54 has an internal impedance $R_G$, labeled 58, equal to the characteristic impedance $Z_O$ of the cable 10.

The voltage response of the apparatus 50, shown where it is measured, is the signal displayed on the video display 56, examples of which are shown in FIGS. 5 and 6.

The characteristic impedance $Z_0$ of the cable 10 is determined by the physical dimensions of the cable, the series resistance and inductance of the sheath and inner-conductor, and by the continuous shunt capacitance between the inner conductor and the sheath. In particular, the characteristic impedance will decrease if the shunt capacitance is increased, and this results wherever the gap between the inner conductor and the sheath is decreased.

When the input pulse is applied, as may be seen in FIG. 5, at 62, the response voltage V rises to some value, and the pulse propagates down the cable 10 to the load resistor 52 where it is reflected back to the input terminal at a later time, 64, and becomes added to the response voltage V.

The addition of the reflected voltage to the input voltage will result in a new voltage which may be larger or smaller or equal to the prior voltage. FIG. 5 shows these three examples at 64. When the load resistance 52 is zero ohms, the response voltage is zero after the addition. When the load resistance 52 is equal to the characteristic impedance of the cable 10 or infinite, the response voltage is, respectively, unchanged or increased by a factor of two after the addition. Thus, the shape of the voltage response trace on the video display permits an evaluation of the load resistance.

Any portion of the cable 10 is in effect a load resistance $R_L$ for that portion of the cable preceeding it on the generator side. When these two portions have identical impedances, there will be no reflection from their arbitrarily selected and imperceptible demarcation in the cable. However, a reflection will result from any demarcation point in the cable 10 where some circumstance causes the adjacent values of characteristic impedance to differ. A decrease in the internal spacing at some point will reduce the characteristic impedance at that point as compared to an adjacent area, and the resulting voltage reflection will decrease the total signal response voltage, 72 in FIG. 6, as was the case for the reflection from the load resistor whose value is less than the cable's characteristic impedance, $R_L=0$.

Obviously, many modifications and variations of the present invention are possible in the light of the above teachings, and, it is therefore understood that within the scope of the disclosed inventive concept, the invention may be practiced otherwise than as specifically described.

What is claimed is:

1. A cable having a vertical plane of symmetry and an axis on this plane which is located below the horizontal center line of the cable, comprising:

an inner metallic conductor, centered about the axis;

a thin, substantially flat, horizontal sheet of insulating material, disposed parallel to the horizontal center line, which makes contact with and supports the conductor at its center elastically; and an outer metallic sheath, at least semirigid, which encloses the conductor and the sheet, the flat sheet having its edges attached to the inside surface of the sheath.

2. The cable according to claim 1, wherein:

the metallic conductor is circular in cross section; and the metallic sheath has the cross section of a hollow cylinder.

3. The cable according to claim 2, wherein:

the metallic conductor and sheath are made of copper.

4. The cable according to claim 2, wherein:

the metallic conductor and sheath are made of stainless steel.

5. The cable according to claim 4, wherein:

the diameter of the inner conductor is in the range of 1.5 mm.

6. The cable according to claim 5 wherein:

the flat sheet is made of Mylar, and has a thickness in the range of 0.1 mm.

7. The cable according to claim 6, wherein:

the sheath has an outside diameter in the range of 1.5 cm and a thickness in the range of 1 mm.

8. The cable according to claim 1, wherein:

the inner conductor is a hollow cylinder.

9. The cable according to claim 1, wherein:

the inner conductor is hollow and has a rectangular cross-section.

10. The cable according to claim 9, wherein:

the outer sheath is also rectangular in cross section.

11. The cable according to claim 10, wherein:

the inner conductor is square in cross section.

12. The cable according to claim 11, wherein:

the outer sheath is square in cross section.

13. A cable comprising:

an outer metallic sheath, configured so as to have a plane of symmetry;

a thin, substantially flat, sheet of insulating material, attached at its edges to the sheath, in a plane perpendicular to the plane of symmetry, the perpendicular plane not intersecting the midline of the sheath on the plane of symmetry; and a thin layer of metal deposited on the central part of the insulating sheet so as to not touch the sheath, the layer of metal being closer to the midline than the insulating sheet.

14. The cable according to claim 13, wherein:

the outer sheath is a hollow cylinder of stainless steel;

the insulating sheet is of Mylar; and the deposited metal is vacuum metallized copper.

15. Intrusion detection apparatus, comprising:

a cable having a vertical plane of symmetry and an axis on this plane which is located below the horizontal center line of the cable, comprising:

an inner metallic conductor, centered about the axis;

a thin, substantially flat, horizontal sheet of insulating material, disposed parallel to the horizontal center line, which makes contact with and supports the conductor at its center elastically; and an outer metallic sheath, at least semirigid, which encloses the conductor and the sheet, the flat sheet having its edges attached to the inside surface of the sheath;

means for terminating the cable in its characteristic impedance;

means, connected to the other termination of the cable, for injecting a pulse into the cable which propagates to the end terminating in the characteristic impedance, to be reflected back to the connecting termination if there is an intrusion; and means, also connected to the other termination of the cable, for displaying the transmitted pulse, and the reflected pulse if any, the display means being capable of showing the precise location of the intrusion and its nature.

16. The intrusion detection apparatus according to claim 15, wherein:

the pulse-injecting means and the displaying means constitute a time-domain reflectometer.

* * * * *